US008596734B2

(12) United States Patent
Jaumot et al.

(10) Patent No.: US 8,596,734 B2
(45) Date of Patent: Dec. 3, 2013

(54) FLUID EJECTION SYSTEM AND METHODS THEREOF

(75) Inventors: Nuria Jornet Jaumot, Barcelona (ES); Andreu Gonzalez Oliva, Barcelona (ES)

(73) Assignee: Hewlett-Packard Development Company, L. P., Houston, TX (US)

( * ) Notice: Subject to any disclaimer, the term of this patent is extended or adjusted under 35 U.S.C. 154(b) by 315 days.

(21) Appl. No.: 13/031,169

(22) Filed: Feb. 18, 2011

(65) Prior Publication Data

US 2012/0212525 A1 Aug. 23, 2012

(51) Int. Cl.
*B41J 29/38* (2006.01)

(52) U.S. Cl.
USPC ..... 347/6

(58) Field of Classification Search
USPC ..... 347/6
See application file for complete search history.

(56) References Cited

U.S. PATENT DOCUMENTS 5,266,975 A * 11/1993 Mochizuki et al. ..... 347/23
6,357,854 B1 * 3/2002 Igval et al. ..... 347/36

* cited by examiner

*Primary Examiner* — Manish S Shah
*Assistant Examiner* — Yaovi Ameh

(57) ABSTRACT

A fluid ejection system includes a fluid receiving unit configured to receive fluid. The fluid receiving unit includes a predetermined fluid storage capacity to store the received fluid. The fluid ejection system also includes a fluid ejector unit having a plurality of nozzles to selectively eject fluid toward the fluid receiving unit at a respective frequency and a remaining fluid determination module configured to determine a remaining amount of the received fluid stored in the fluid receiving unit. The remaining amount of the received fluid is based on a respective variable fluid evaporation ratio corresponding to the respective frequency of the ejected fluid and an ejected amount of the fluid ejected toward the fluid receiving unit from the fluid ejector unit.

20 Claims, 5 Drawing Sheets

FLUID EJECTION SYSTEM AND METHODS THEREOF

BACKGROUND

Fluid ejection systems such as inkjet printing systems selectively eject fluid such as ink through nozzles of a fluid applicator unit such as an inkjet print head. During a print mode, the inkjet print head selectively ejects the ink onto a print media to form images. During a maintenance mode, the inkjet print head may selectively eject ink drops toward a fluid receiving unit to reduce clogging of the nozzles thereof by dried ink.

BRIEF DESCRIPTION OF THE DRAWINGS

Non-limiting examples are described in the following description, read with reference to the figures attached hereto and do not limit the scope of the claims. Dimensions of components and features illustrated in the figures are chosen primarily for convenience and clarity of presentation and are not necessarily to scale. Referring to the attached figures:

DETAILED DESCRIPTION

Fluid ejection systems such as inkjet printing systems may include an application mode such as a print mode, a maintenance mode, a fluid ejector unit, and a fluid receiving unit. The fluid ejector unit may selectively eject fluid through nozzles thereof and the fluid receiving unit may receive fluid ejected by the fluid ejector unit. The fluid ejector unit may selectively eject fluid through the nozzles thereof such as ink, during a print mode, in order to print images on a print media. Periodically, the fluid ejector unit may also selectively eject fluid through the nozzles thereof toward the fluid receiving unit, during a maintenance mode, to prevent the nozzles from being obstructed, for example, by dried ink. The fluid receiving unit has a predetermined fluid storage capacity and is configured to receive and store fluid therein. The fluid receiving unit may be replaced by a user or service technician, for example, when the fluid ejection system alerts the user of a full fluid state.

Presently, fluid ejection systems estimate the full fluid state of the fluid receiving unit based on a fixed fluid evaporation ratio and a predetermined fluid storage capacity. Such estimation, however, is prone to inaccuracies as the fluid evaporation ratio is variable rather than fixed. Consequently, increased costs due to premature replacement of the fluid receiving unit and damage sustained by the fluid ejection system due to a fluid overflow state of the fluid receiving unit may be incurred. In examples of the present disclosure, fluid ejection systems determine the full fluid state of the fluid receiving unit based on a variable fluid evaporation ratio of the fluid corresponding to the respective frequency and an ejected amount of the fluid ejected toward the fluid receiving unit from the fluid ejector unit. Accordingly, inaccuracies in determining the full fluid state of the fluid receiving unit are reduced. Consequently, increased costs due to premature changing of the fluid receiving unit and potential damage sustained by the fluid ejection system due to a fluid overflow state of the fluid receiving unit may be reduced.

Figure 1:
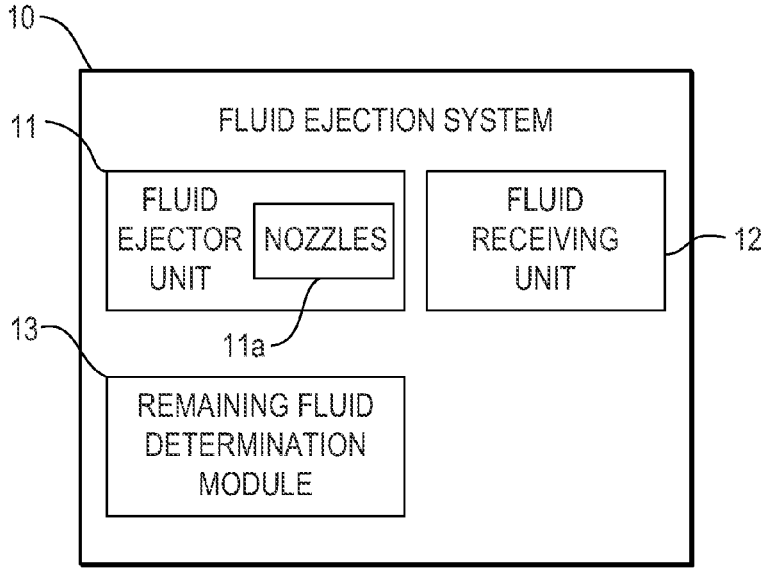
FIG. 1 is a block diagram illustrating a fluid ejection system according to an example.
Figure 2:
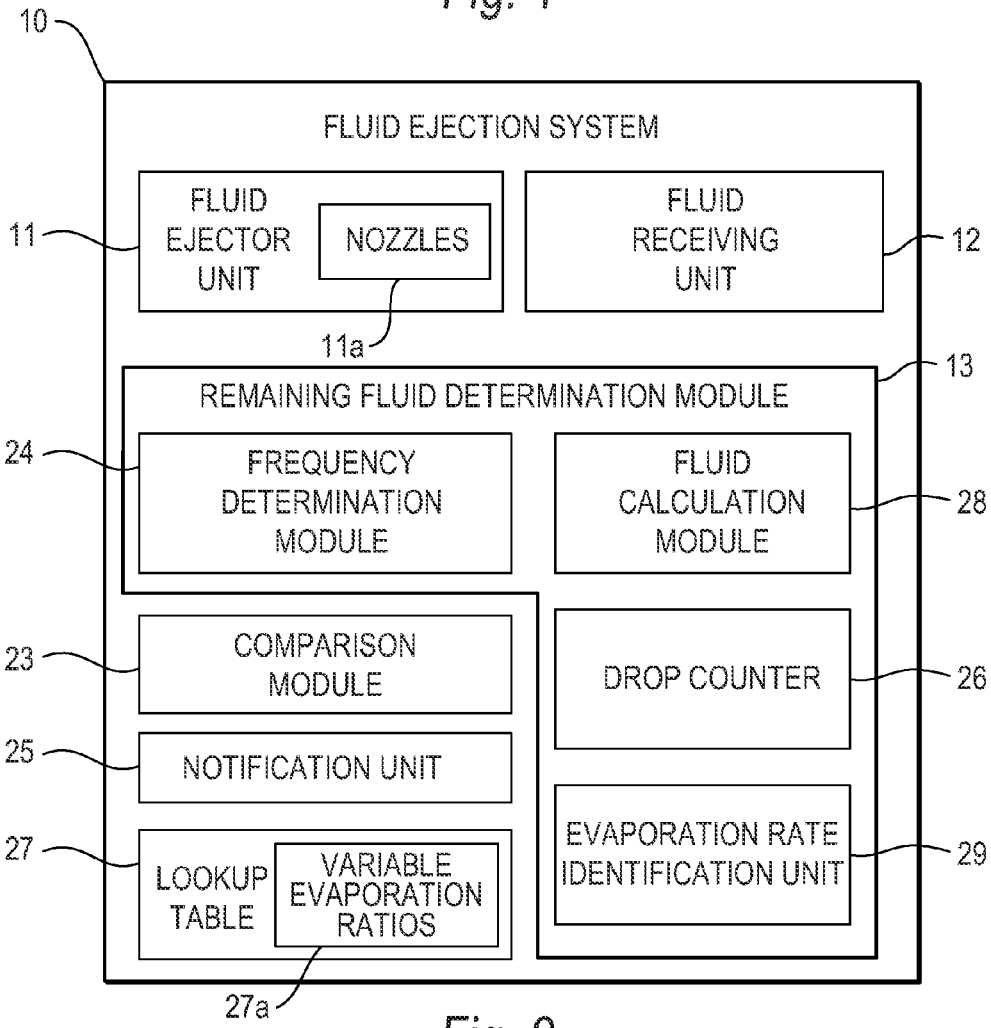
FIG. 2 is a block diagram illustrating the fluid ejection system of FIG. 1 according to another example.

FIG. 1 is a block diagram illustrating a fluid ejection system according to an example. FIG. 2 is a block diagram illustrating the fluid ejection system of FIG. 1 according to another example. Referring to FIGS. 1 and 2, in examples, a fluid ejection system 10 includes a fluid ejector unit 11, a fluid receiving unit 12, and a remaining fluid determination module 13. The fluid ejector unit 11 includes a plurality of nozzles 11*a* to selectively eject fluid. For example, in an application mode such as a print mode, the fluid ejector unit 11 may selectively eject fluid onto a print media. Alternatively, in a maintenance mode, the fluid ejector unit 11 may selectively eject fluid toward the fluid receiving unit 12 at a respective frequency. The respective frequency corresponds to the amount of fluid ejected from the fluid ejector unit 11 toward the fluid receiving unit 12 over a predetermined period of time. For example, the respective frequency may be measured in units of amount per time such as milliliters (ml) per day, picoliters (pl) per hour, or the like. Accordingly, the respective frequency corresponds to a frequency (e.g., usage rate) of the respective fluid ejected by the fluid ejection unit 11 toward the fluid receiving unit 12. That is, high usage of the respective fluid will have a higher frequency value than low usage thereof.

Figure 3:
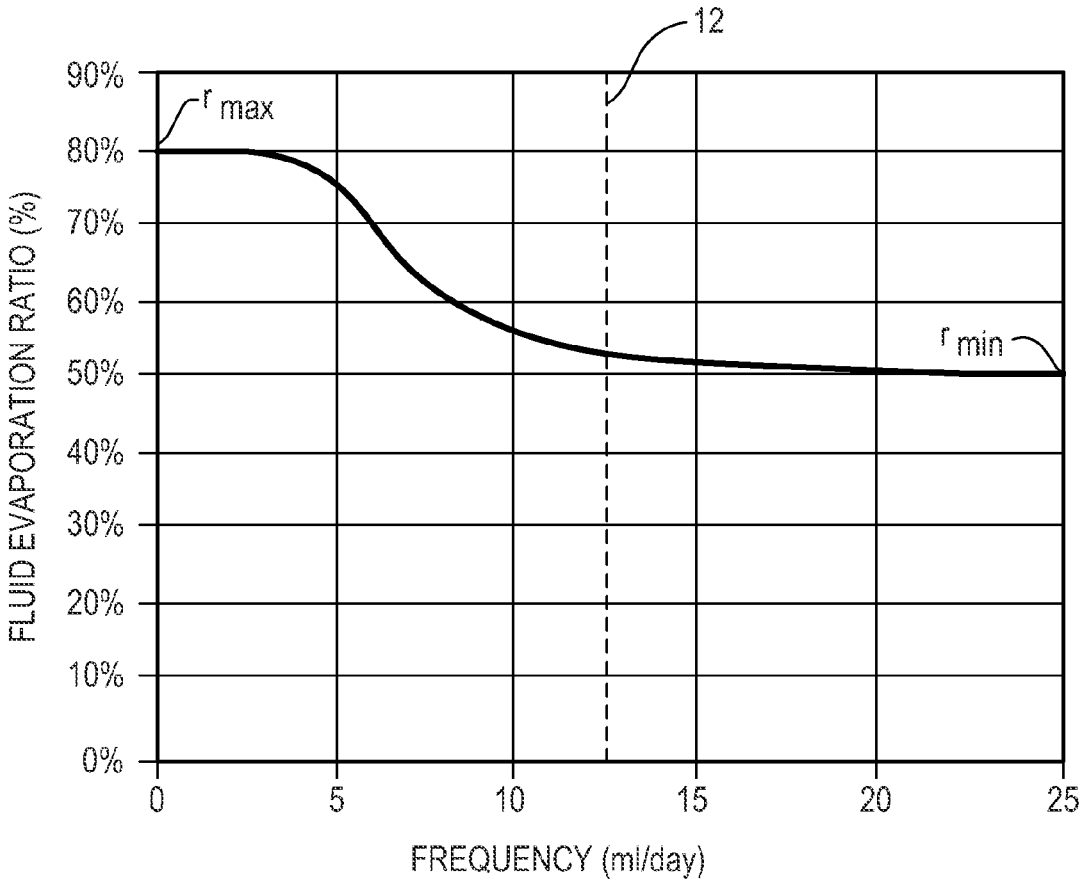
FIG. 3 is a chart diagram illustrating a variable fluid evaporation ratio of water-based inks according to an example.

Referring to FIGS. 1 and 2, the fluid receiving unit 12 is configured to receive fluid and has a predetermined fluid storage capacity to store the received fluid from the fluid ejector unit 11. That is, the fluid receiving unit 12 is of a respective size to hold a specific volume of received fluid therein. In an example, the fluid receiving unit 12 may be removably installed in the fluid ejection system 10. The remaining fluid determination module 13 is configured to determine a remaining amount of the received fluid stored in the fluid receiving unit 12 based on a respective variable fluid evaporation ratio of the ejected fluid corresponding to the respective frequency and an ejected amount of the fluid ejected toward the fluid receiving unit 12 from the fluid ejector unit 11. That is, the fluid evaporation rate of a respective fluid may vary based on at least the frequency in which the respective fluid is being used such that an increase in frequency generally results in a decrease in the fluid evaporation ratio, for example, as illustrated in FIG. 3.

In examples, the remaining fluid determination module 13 may be implemented in hardware, software, or in a combination of hardware and software. In other examples, the remaining fluid determination module 13 may be implemented in whole or in part as a computer program stored in the fluid ejection system 10 locally or remotely, for example, in a memory such as a server or a host computing device considered herein to be part of the fluid ejection system 10. In an example, the remaining fluid determination module 13 may include a drop counter 26, a frequency determination module 24, an evaporation rate identification unit 29, and a fluid calculation module 28 as illustrated in FIG. 3.

Referring to FIG. 2, the drop counter 26 is configured to count a number of fluid drops $d_n$ ejected toward the fluid receiving unit 12 from the fluid ejector unit 11 over a predetermined period of time $t_p$. In an example, the drop counter 26 may restart the count each time a respective fluid receiving unit 12 is replaced and/or the accumulated received fluid is emptied therefrom. The frequency determination module 24 is configured to determine a respective frequency f in which the fluid ejector unit 11 ejects fluid toward the fluid receiving unit 12 over the predetermined period of time $t_p$. In an example, the frequency determination module 24 may determine a respective frequency f by calculating an amount of the respective fluid ($d_n$*$d_v$) ejected over a predetermined time period $t_p$. For example, the frequency determination module 24 may multiply the counted number of fluid drops $d_n$ by a predetermined drop volume $d_v$ divided by the predetermined amount of time $t_p$ in accordance with Equation 1. In an example, the predetermined drop volume $d_v$, for example, may be supplied from the manufacturer of the fluid ejector unit 11 and accessed by the frequency determination module 24 through memory.

$$f=(d_n*d_v)/t_p, \text{ wherein} \qquad \text{Equation 1}$$

f corresponds to a respective frequency;

$d_n$ corresponds to a counted number of fluid drops ejected toward a fluid receiving unit from a fluid ejector unit during a predetermined period of time;

$d_v$ corresponds to a corresponding drop volume; and $t_p$ corresponds to the predetermined period of time.

Referring to FIG. 2, the evaporation rate identification unit 29 is configured to identify the respective variable fluid evaporation ratio $e_v$ of the ejected fluid corresponding to the determined respective frequency f by the frequency determination module 24. For example, the evaporation rate identification unit 29 may identify a respective evaporation rate $e_v$ corresponding to the respective frequency f determined by the frequency determination module 24, for example, in a lookup table 27 or the like. In an example, the fluid calculation module 28 calculates the respective remaining amount of the received fluid $r_t$ stored in the fluid receiver unit 12 by multiplying the counted number or fluid drops $d_n$ by the predetermined drop volume $d_v$ by the identified respective evaporation rate $e_v$ and adds respective previously calculated remaining amounts of received fluid $r_p$ stored in the respective fluid receiver unit 12 thereto in accordance with Equation 2.

$$r_t=(d_n*d_v*e_v)+r_p, \text{ wherein} \qquad \text{Equation 2}$$

$r_t$ corresponds to a calculated total remaining amounts of received fluid stored in a respective fluid receiver unit;

$d_n$ corresponds to a counted number of fluid drops ejected toward a fluid receiving unit from a fluid ejector unit during a predetermined period of time;

$d_v$ corresponds to a corresponding drop volume;

$e_v$ corresponds to a respective evaporation rate corresponding to a respective frequency determined by a frequency determination module; and $r_p$ corresponds to respective previously calculated remaining amounts of received fluid stored in the respective fluid receiver unit.

As illustrated in FIG. 2, in examples, the fluid ejection system 10 may also include a lookup table 27, a comparison module 23 and a notification unit 25. In an example, the lookup table 27 may include a plurality of variable fluid evaporation ratios 27*a* to be stored in memory of the fluid ejection system 10. The memory, for example, may include local memory such as non-volatile and volatile memory, firmware and the like, and/or non-local memory in communication with the fluid ejection system 10, for example, wirelessly and/or through a network. The variable fluid evaporation ratios may correspond to the respective type of fluid to be used in the fluid ejection system 10 and a range of frequencies associated therewith.

Referring to FIG. 2, the comparison module 23 is configured to compare the remaining amount of the received fluid $r_t$ stored in the fluid receiving unit 12 with a predetermined reference limit to determine when the remaining amount of the received fluid $r_t$ is at least one of equal to and greater than the predetermined reference limit. In an example, the predetermined reference limit corresponds to a fluid storage capacity of the fluid receiver unit 12 in a full fluid state. The full fluid state, for example, may be when the fluid stored in the fluid receiving unit 12 occupies the entire predetermined fluid storage capacity thereof. In an example, the predetermined fluid storage capacity, for example, may be supplied from the manufacturer of the fluid receiving unit 12 and accessed by the fluid ejection system 10 through memory. The predetermined reference limit may be a fluid storage capacity corresponding to a full fluid state or nearly full fluid state. For example, the predetermined reference limit may be a fluid storage capacity in a range from eighty percent to one hundred percent of the predetermined fluid storage capacity thereof.

In an example, the notification unit 25 is configured to provide a user notification alert when the remaining amount of the received fluid is determined by the comparison module 23 to be at least one of equal to and greater than the predetermined reference limit $r_t$. In examples, the user notification alert may be an audio alarm and/or visual alarm such as activating a light, providing a message on a display, providing sound through a speaker, or the like. Accordingly, a user notification alert may be provided, for example, to notify a user of a state of the fluid receiving unit 12. That is, the user may be alerted to replace the fluid receiving unit 12 or empty the received fluid therefrom, for example, by a user or service technician, as the fluid receiving unit 12 is in and/or is closely approaching a full fluid state. Accordingly, the fluid ejection system 10 of the present disclosure assists in the prevention of the fluid receiving unit 12 being prematurely replaced resulting in increased costs by accurately determining when the respective predetermined reference limit is reached and providing a user notification alert in response thereto. In addition, the fluid ejection system 10 of the present disclosure assists in the prevention of the fluid receiving unit 12 achieving an overflow state resulting in a detrimental impact thereto by accurately determining when the respective predetermined reference limit is reached and providing a user notification alert in response thereto.

FIG. 3 is a chart diagram illustrating a variable fluid evaporation ratio of water-based inks according to an example. Referring to FIG. 3, for example, as the frequency goes from 1 ml/day to 25 ml/day, the fluid evaporation ratio goes from approximately eighty percent to approximately fifty percent. In an example, the variable fluid evaporation ratio has a maximum fluid evaporation ratio $r_{max}$ of less than one hundred percent and a minimum fluid evaporation ratio $r_{min}$ of more than zero percent. Referring to FIG. 3, in an example, the maximum fluid evaporation ratio $r_{max}$ may be in a range from seventy-five percent to eighty-five percent and the minimum fluid evaporation ratio $r_{min}$ may be in a range from forty-five percent to fifty-five percent. Referring to FIG. 3, the variable fluid evaporation ratio approaches a maximum fluid evaporation ratio $r_{max}$ of approximately eighty percent when the frequency is less than approximately five ml/day and approaches a minimum fluid evaporation ratio $r_{min}$ of approximately fifty percent when the frequency is greater than approximately twelve ml/day. In an example, the maximum fluid evaporation ratio $r_{max}$ may be based on the fluid having a solid portion that does not evaporate. In examples, the minimum fluid evaporation ratio $r_{min}$ may be based on one or more of a heating of the fluid and a portion of the fluid forming aerosol particles therefrom having a light weight that such aerosol particles are not received by the fluid receiving unit 12.

Figure 4:
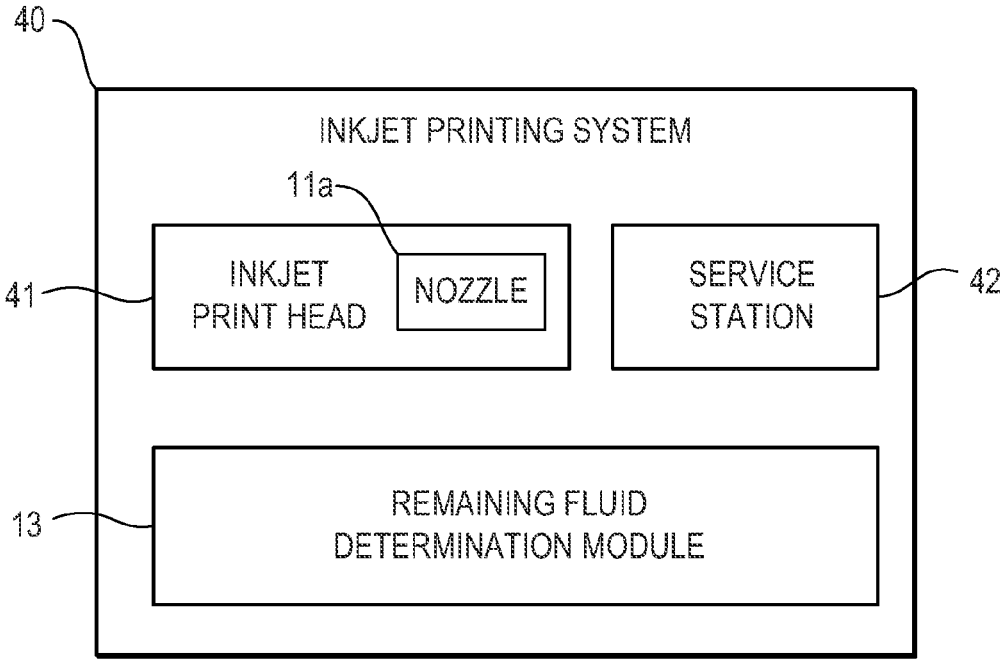
FIG. 4 is a block diagram illustrating an inkjet printing system according to an example.

FIG. 4 is a block diagram illustrating an inkjet printing system according to an example. Referring to FIG. 4, in the present example, the fluid ejection system may be an image forming apparatus such as an inkjet printing system 40 and the fluid ejector unit may be an inkjet print head 41. In examples, image forming apparatus may be a digital copier, printer, bookmaking machine, facsimile machine, multi-function machine, or the like. The fluid receiving unit 12 may include a service station 42 configured to selectively maintain the fluid ejector unit 12 such as receiving fluid ejected through nozzles 11*a* of the inkjet print head 41. In an example, the service station 42 may also include a wiping member and/or a cap member, or the like. The fluid may include ink or other types of fluids. The term ink is used generally herein, and encompasses any type of pigment or colorant such as toner, or other type of image forming material, and may be in a variety of forms such as liquid, semi-liquid, dry, powder, solid, semi-solid, or other forms that is used to be ejected by a fluid ejection system 10. The inkjet printing system 40 may also include the remaining fluid determination module 13 as previously disclosed with reference to FIGS. 1 and 2.

Figure 5:
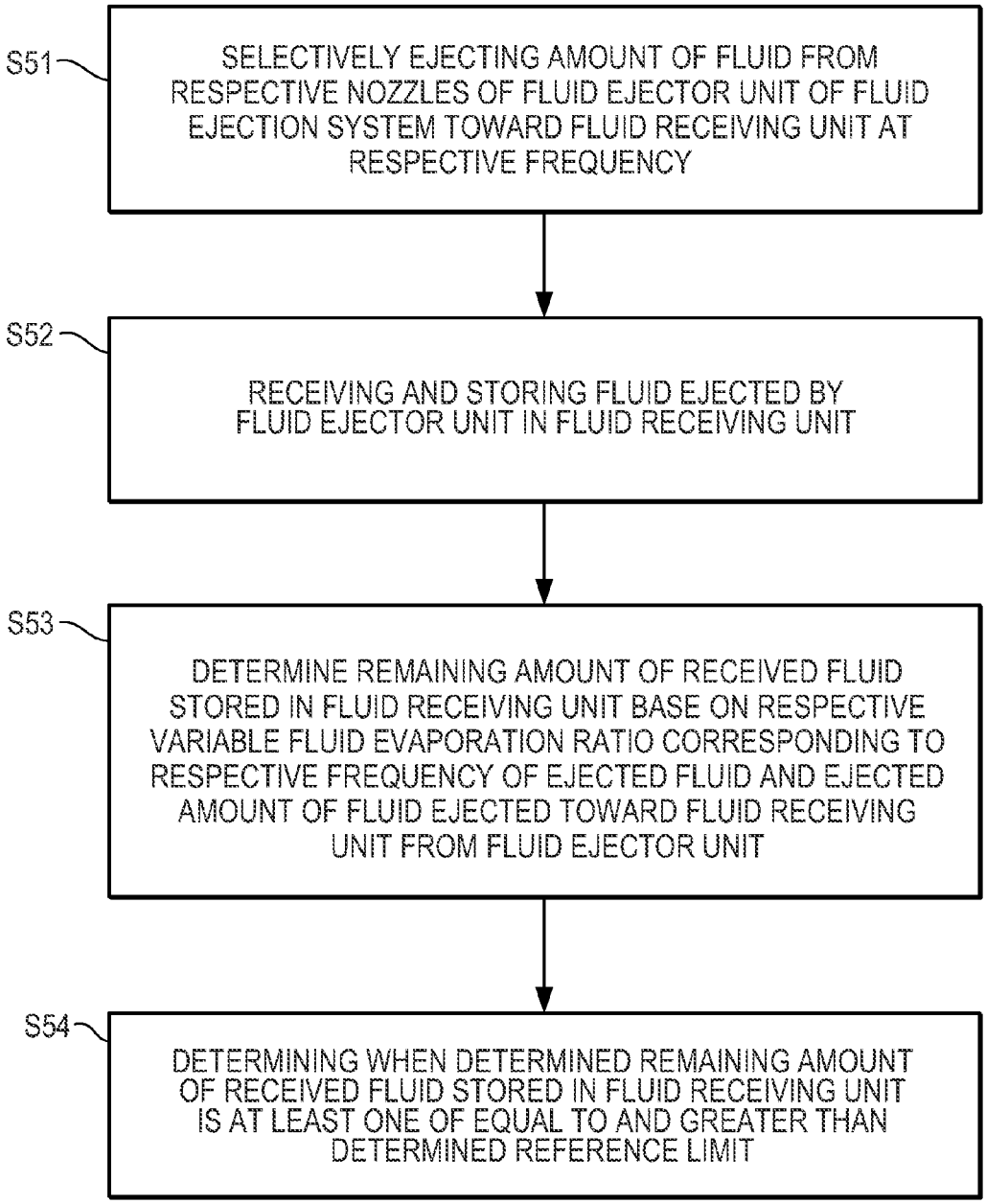
FIG. 5 is a flowchart illustrating a method of determining when a predetermined reference limit is reached by fluid ejected from a fluid ejection unit of a fluid ejection system according to an example.

FIG. 5 is a flowchart illustrating a method of determining when a predetermined reference limit is reached by fluid ejected from a fluid ejection unit of a fluid ejection system according to an example. Referring to FIG. 5, in block S51, an amount of fluid is selectively ejected from respective nozzles of a fluid ejector unit of a fluid ejection system toward a fluid receiving unit at a respective frequency. In block S52, fluid ejected by the fluid ejector unit is received and stored in the fluid receiving unit. In block S53, a remaining amount of the received fluid stored in the fluid receiving unit is determined based on a respective variable fluid evaporation ratio corresponding to the respective frequency of the ejected fluid and the ejected amount of the fluid ejected toward the fluid receiving unit from the fluid ejector unit. In block S54, when the determined remaining amount of the received fluid stored in the fluid receiving unit is at least one of equal to and greater than a predetermined reference limit is determined.

Figure 6:
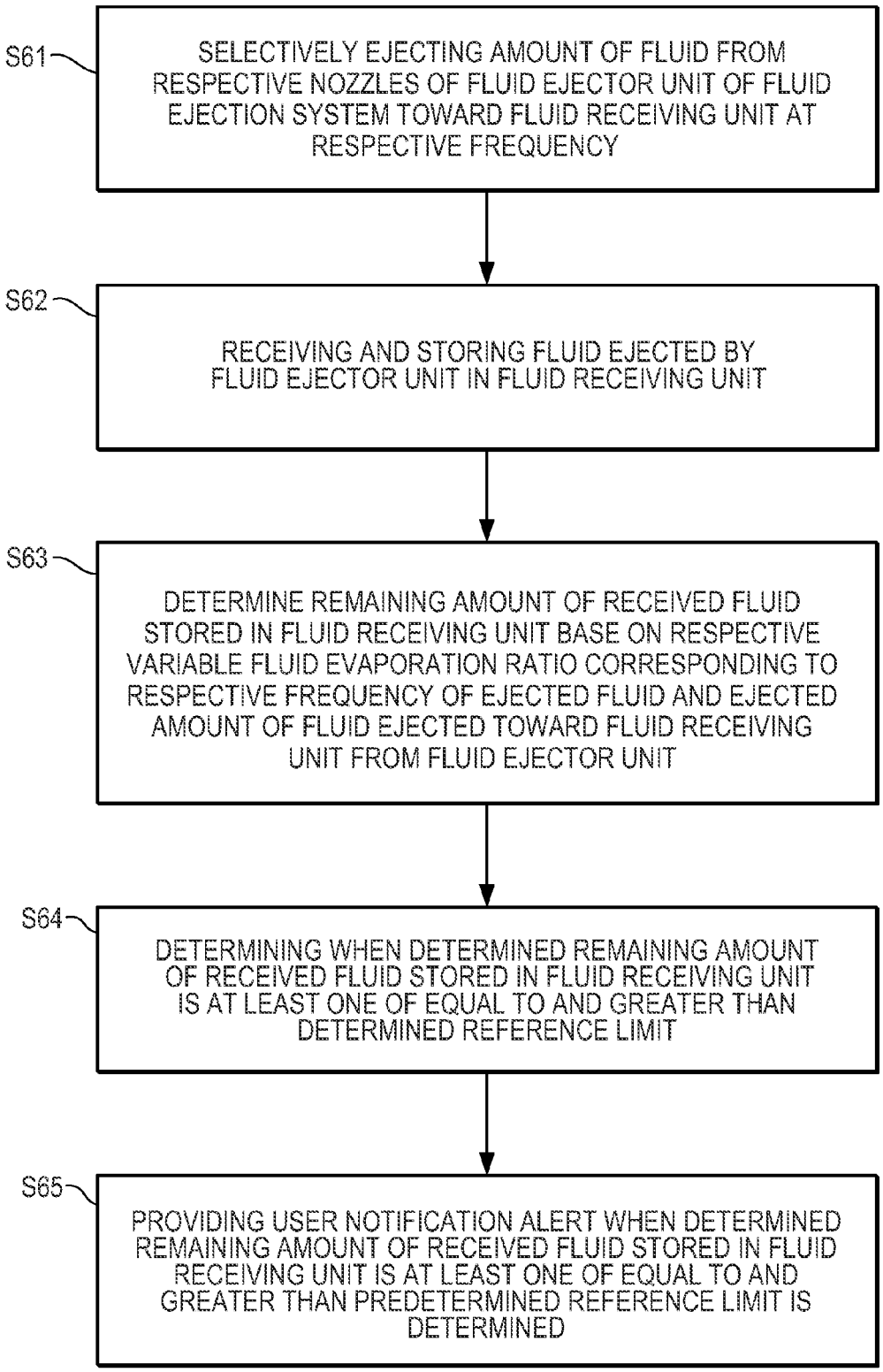
FIG. 6 is a flowchart illustrating a method of providing a user notification alert when a determined remaining amount of received fluid stored in a fluid receiving unit is at least one of equal to and greater than a predetermined reference limit according to an example.

FIG. 6 is a flowchart illustrating a method of providing a user notification alert when a determined remaining amount of received fluid stored in a fluid receiving unit is at least one of equal to and greater than a predetermined reference limit according to an example. Referring to FIG. 6, in block S61, an amount of fluid is selectively ejected from respective nozzles of a fluid ejector unit of a fluid ejection system toward a fluid receiving unit at a respective frequency. In block S62, fluid ejected by the fluid ejector unit is received and stored in the fluid receiving unit. In block S63, a remaining amount of the received fluid stored in the fluid receiving unit is determined based on a respective variable fluid evaporation ratio corresponding to the respective frequency of the ejected fluid and the ejected amount of the fluid ejected toward the fluid receiving unit from the fluid ejector unit. In block S64, when the determined remaining amount of the received fluid stored in the fluid receiving unit is at least one of equal to and greater than a predetermined reference limit. In block S65, a user notification alert is provided when the determined remaining amount of the received fluid stored in the fluid receiving unit is at least one of equal to and greater than the predetermined reference limit.

It is to be understood that the flowcharts of FIGS. 5 and 6 illustrate an architecture, functionality, and operation of examples of the present disclosure. If embodied in software, each block may represent a module, segment, or portion of code that includes one or more executable instructions to implement the specified logical function(s). If embodied in hardware, each block may represent a circuit or a number of interconnected circuits to implement the specified logical function(s). Although the flowcharts of FIGS. 5 and 6 illustrate a specific order of execution, the order of execution may differ from that which is depicted. For example, the order of execution of two or more blocks may be scrambled relative to the order illustrated. Also, two or more blocks illustrated in succession in FIGS. 5 and 6 may be executed concurrently or with partial concurrence. All such variations are within the scope of the present disclosure.

Figure 7:
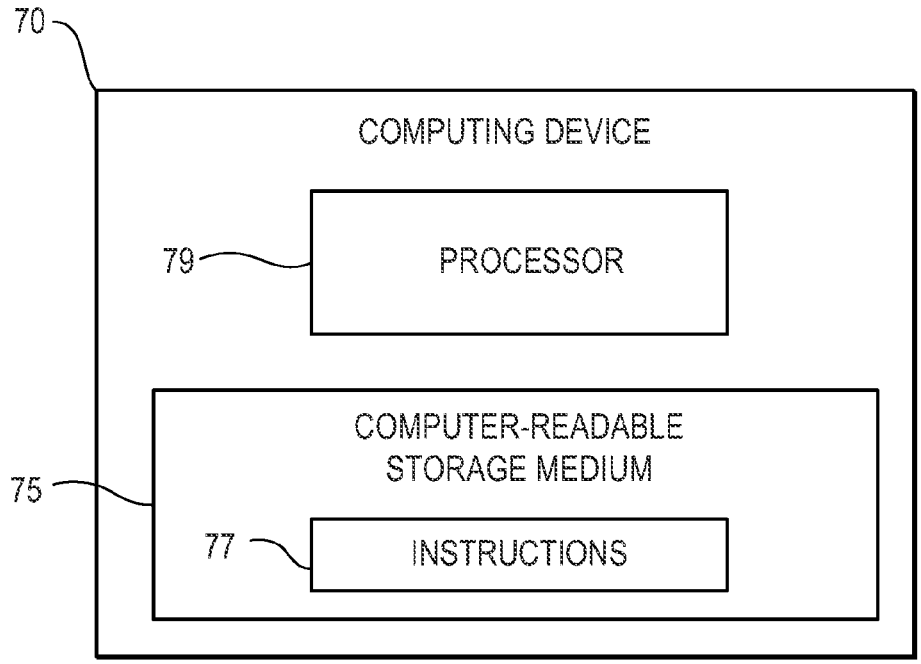
FIG. 7 is a block diagram of the method of FIG. 6 embodied in a computer-readable storage medium according to an example.

FIG. 7 is a block diagram of the method of FIG. 6 embodied in a computer-readable storage medium according to an example. Referring to FIG. 7, in examples, the present disclosure may be embodied in any computer-readable storage medium 75 for use by or in connection with an instruction-execution system, apparatus or device such as a computer/processor based system, processor 79 or other system (computing device 70) that can fetch the instructions from the instruction-execution system, apparatus or device, and execute the instructions 77 contained therein. In the context of this disclosure, a computer-readable storage medium 77 can be any means that can store, communicate, propagate or transport instructions 77 for use by or in connection with the computing device 70 such as a fluid ejection system 10. The computer-readable storage medium 75 can include any one of many physical media such as, for example, electronic, magnetic, optical, electromagnetic, infrared, or semiconductor media.

More specific examples of computer-readable storage medium would include, but are not limited to, a portable magnetic computer diskette such as floppy diskettes or hard drives, a random access memory (RAM), a read-only memory (ROM), an erasable programmable read-only memory, or a portable compact disc. It is to be understood that the computer-readable storage medium 75 could even be paper or another suitable medium upon which the instructions 77 are printed, as the instructions 77 can be electronically captured, via, for instance, optical scanning of the paper or other medium, then compiled, interpreted or otherwise processed in a single manner, if necessary, and then stored therein. The computer-readable storage medium 75 includes instructions 77 executed, for example, by the processor 79 and, that when executed, cause the processor 79 and/or computing device 70 to perform some or all of the functionality described herein.

Those skilled in the art will understand that various examples of the present disclosure can be implemented in hardware, software, firmware or combinations thereof. Separate examples can be implemented using a combination of hardware and software or firmware that is stored in memory and executed by a suitable instruction-execution system. If implemented solely in hardware, as in an alternative example, the present disclosure can be separately implemented with any or a combination of technologies such as discrete-logic circuits, application-specific integrated circuits (ASICs), programmable-gate arrays (PGAs), field-programmable gate arrays (FPGAs), and/or other later developed technologies. In other examples, the present disclosure can be implemented in a combination of software and data executed and stored under the control of a computing device. Once given the above disclosure, many other features, modifications or improvements will become apparent to the skilled artisan. Such features, modifications or improvements are, therefore, considered to be a part of the present disclosure, the scope of which is to be determined by the following claims.

What is claimed is:

1. A fluid ejection system, comprising:

a fluid receiving unit configured to receive fluid, the fluid receiving unit having a predetermined fluid storage capacity to store the received fluid;

a fluid ejector unit having a plurality of nozzles to selectively eject fluid toward the fluid receiving unit at a respective frequency, the respective frequency corresponding to an amount of the fluid ejected from the fluid ejector unit toward the fluid receiving unit over a predetermined period of time; and a remaining fluid determination module configured to determine a remaining amount of the received fluid stored in the fluid receiving unit based on the amount of the fluid ejected from the fluid ejector unit toward the fluid receiving unit and a respective variable fluid evaporation ratio of the ejected fluid corresponding to the respective frequency of the ejected fluid.

2. The fluid ejection system according to claim 1, wherein the respective variable fluid evaporation ratio is identified from a lookup table including a plurality of variable fluid evaporation ratios for a range of frequencies of the ejected fluid.

3. The fluid ejection system according to claim 1, further comprising:

a comparison module configured to compare the determined remaining amount of the received fluid stored in the fluid receiving unit with a predetermined reference limit to determine when the remaining amount of the received fluid is at least one of equal to and greater than the predetermined reference limit.

4. The fluid ejection system according to claim 3, further comprising:

a notification unit configured to provide a user notification alert when the determined remaining amount of the received fluid is at least one of equal to and greater than the predetermined reference limit.

5. The fluid ejection system according to claim 1, wherein the fluid evaporation ratio varies based on the frequency of the ejected fluid.

6. The fluid ejection system according to claim 1, wherein the remaining fluid determination unit comprises:

a drop counter configured to count a number of fluid drops ejected from the fluid ejector unit toward the fluid receiving unit over the predetermined period of time;

a frequency determination module configured to determine the respective frequency of the ejection of the counted number of the fluid drops ejected from the fluid ejector unit toward the fluid receiving unit over the predetermined period of time;

an evaporation rate identification unit configured to identify the respective variable fluid evaporation ratio corresponding to the determined respective frequency of the ejection of the counted number of the fluid drops; and a fluid calculation module configured to calculate the remaining amount of the received fluid stored in the fluid receiving unit.

7. The fluid ejection system according to claim 6, wherein the fluid calculation module calculates the respective remaining amount of the received fluid stored in the fluid receiving unit by multiplying the counted number of the fluid drops by a predetermined drop volume and the identified respective variable fluid evaporation ratio, and adding a respective previously calculated remaining amount of the received fluid stored in the fluid receiving unit.

8. The fluid ejection system according to claim 6, wherein the identified respective variable fluid evaporation ratio is identified by the evaporation rate identification unit from a lookup table.

9. The fluid ejection system according to claim 1, wherein the variable fluid evaporation ratio has a maximum fluid evaporation ratio of less than one hundred percent and a minimum fluid evaporation ratio of more than zero percent.

10. The fluid ejection system according to claim 1, wherein the fluid receiving unit comprises:

a removably installed service station configured to selectively maintain the fluid ejector unit.

11. The fluid ejection system according to claim 1, wherein the fluid ejector unit comprises an inkjet print head, the fluid comprises ink, and the fluid ejection system comprises an inkjet printing system.

12. A method of determining when a predetermined reference limit is reached by fluid ejected from a fluid ejector unit of a fluid ejection system, the method comprising:

selectively ejecting an amount of fluid from respective nozzles of a fluid ejector unit of a fluid ejection system toward a fluid receiving unit at a respective frequency, the respective frequency corresponding to the amount of the fluid ejected from the fluid ejector unit toward the fluid receiving unit over a predetermined period of time;

receiving and storing fluid ejected by the fluid ejector unit in the fluid receiving unit;

determining a remaining amount of the received fluid stored in the fluid receiving unit based on the amount of the fluid ejected from the fluid ejector unit toward the fluid receiving unit and a respective variable fluid evaporation ratio of the ejected fluid corresponding to the respective frequency of the ejected fluid; and determining when the determined remaining amount of the received fluid stored in the fluid receiving unit is at least one of equal to and greater than a predetermined reference limit.

13. The method according to claim 12, identifying the respective variable fluid evaporation ratio from a lookup table including a plurality of variable fluid evaporation ratios for a range of frequencies of the ejected fluid.

14. The method according to claim 12, further comprising:

providing a user notification alert when the determined remaining amount of the received fluid stored in the fluid receiving unit is at least one of equal to and greater than the predetermined reference limit.

15. The method according to claim 12, wherein an increase in the frequency of the ejected fluid results in a decrease of the variable fluid evaporation ratio.

16. The method according to claim 12, wherein the determining a remaining amount of the received fluid stored in the fluid receiving unit comprises:

counting, by a drop counter, a number of fluid drops ejected from the fluid ejector unit toward the fluid receiving unit over the predetermined period of time;

determining, by a frequency determination module, the respective frequency of the ejection of the counted number of the fluid drops ejected from the fluid ejector unit toward the fluid receiving unit by over the predetermined period of time;

identifying, by an evaporation rate identification unit, the respective variable fluid evaporation ratio corresponding to the determined respective frequency of the ejection of the counted number of the fluid drops by the frequency determination module; and calculating, by a fluid calculation module, the remaining amount of the received fluid stored in the fluid receiving unit.

17. The method according to claim 16, wherein the calculating the remaining amount of the received fluid stored in the fluid receiving unit comprises:

multiplying the counted number of the fluid drops by a predetermined drop volume and the identified respective variable fluid evaporation ratio, and adding a previously calculated remaining amount of the received fluid stored in the fluid receiving unit.

18. The method according to claim 16, wherein the identified respective variable fluid evaporation ratio is identified by the evaporation rate identification unit from a lookup table.

19. The method according to claim 12, wherein the variable fluid evaporation ratio has a maximum fluid evaporation ratio of less than one hundred percent and a minimum fluid evaporation ratio of more than zero percent.

20. A non-transitory computer-readable storage medium having embodied thereon a computer program to execute a method, wherein the method comprises:

selectively ejecting an amount of fluid from respective nozzles of a fluid ejector unit of a fluid ejection system toward a fluid receiving unit at a respective frequency, the respective frequency corresponding to the amount of the fluid ejected from the fluid ejector unit toward the fluid receiving unit over a predetermined period of time;

receiving and storing fluid ejected by the fluid ejector unit in the fluid receiving unit;

determining a remaining amount of the received fluid stored in the fluid receiving unit based on the amount of the fluid ejected from the fluid ejector unit toward the fluid receiving unit and a respective variable fluid evaporation ratio of the ejected fluid corresponding to the respective frequency of the ejected fluid; and determining when the determined remaining amount of the received fluid stored in the fluid receiving unit is at least one of equal to and greater than a predetermined reference limit.

* * * * *

UNITED STATES PATENT AND TRADEMARK OFFICE

CERTIFICATE OF CORRECTION

PATENT NO. : 8,596,734 B2
APPLICATION NO. : 13/031169
DATED : December 3, 2013
INVENTOR(S) : Nuria Jornet Jaumot et al.

It is certified that error appears in the above-identified patent and that said Letters Patent is hereby corrected as shown below:

On the title page, Item (73), Assignee, in column 1, line 2, delete "L. P.," and insert -- L.P., --, therefor.

Signed and Sealed this
Third Day of June, 2014

Michelle K. Lee

Michelle K. Lee
*Deputy Director of the United States Patent and Trademark Office*